US007699633B2

(12) United States Patent
Cheng

(10) Patent No.: US 7,699,633 B2
(45) Date of Patent: Apr. 20, 2010

(54) POSITIONING STRUCTURE FOR USB CONNECTOR

(75) Inventor: Da-Qing Cheng, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/141,092

(22) Filed: Jun. 18, 2008

(65) Prior Publication Data

US 2009/0170376 A1 Jul. 2, 2009

(30) Foreign Application Priority Data

Dec. 27, 2007 (CN) ..... 2007 1 0203479

(51) Int. Cl.
*H01R 13/46* (2006.01)

(52) U.S. Cl. ..... 439/248; 439/374; 439/544

(58) Field of Classification Search ..... 439/246, 439/247, 248, 374, 544
See application file for complete search history.

(56) References Cited

U.S. PATENT DOCUMENTS 5,823,815 A * 10/1998 Takata ..... 439/374
7,527,522 B2 * 5/2009 Kondou ..... 439/552
2009/0170376 A1 * 7/2009 Cheng ..... 439/660

* cited by examiner

*Primary Examiner*—James Harvey
(74) *Attorney, Agent, or Firm*—Zhigang Ma

(57) ABSTRACT

An exemplary positioning structure is used for a USB connector assembled with an electronic device including a main body. The positioning structure includes a through hole defined in the main body, and a guiding portion configured on a periphery of an inner sidewall of the through hole.

2 Claims, 5 Drawing Sheets

POSITIONING STRUCTURE FOR USB CONNECTOR

BACKGROUND

1. Field of the Invention

The present invention generally relates to positioning structures, and particularly to a positioning structure for a USB connector to an electronic device.

2. Discussion of the Related Art

In recent years, there has been an increasing demand for electronic devices, such as personal computers, personal digital assistants (PDAs), mobile phones, MP3 players, and MP4 players. Commonly, the electronic devices use a variety of techniques for providing input and output. A universal serial bus (USB) device may provide for ease of use of peripheral expansion, thus USB connectors are widely used on the electronic devices recently.

For example, in the personal computers, before the USB devices is used, socket/male portions of the USB connectors of the USB devices are commonly assembled in a through hole defined on a housing of the personal computers.

However, a process of engaging the socket/male portions of the USB connectors in the through hole of the electronic devices requires high precision. Thus, this process of connecting a USB connector cannot completed as quick as desired.

What is needed, therefore, is a positioning structure for a USB connector that can overcome the above-mentioned shortcomings.

SUMMARY

A positioning structure is used for a USB connector assembled with an electronic device including a main body. The positioning structure includes a through hole defined in the main body, and a guiding portion configured on a periphery of an inner sidewall of the through hole.

Other novel features will become more apparent from the following detailed description, when taken in conjunction with the accompanying drawings.

BRIEF DESCRIPTION OF THE DRAWINGS

The components in the drawings are not necessarily drawn to scale, the emphasis instead being placed upon clearly illustrating the principles of the present positioning structure for assembling the USB connector. Moreover, in the drawings, like reference numerals designate corresponding parts throughout several views, and all the views are schematic.

DETAILED DESCRIPTION OF THE EMBODIMENTS

Reference will now be made to the drawings to describe exemplary embodiments of the present positioning structure for the USB connector in detail.

Figure 1:
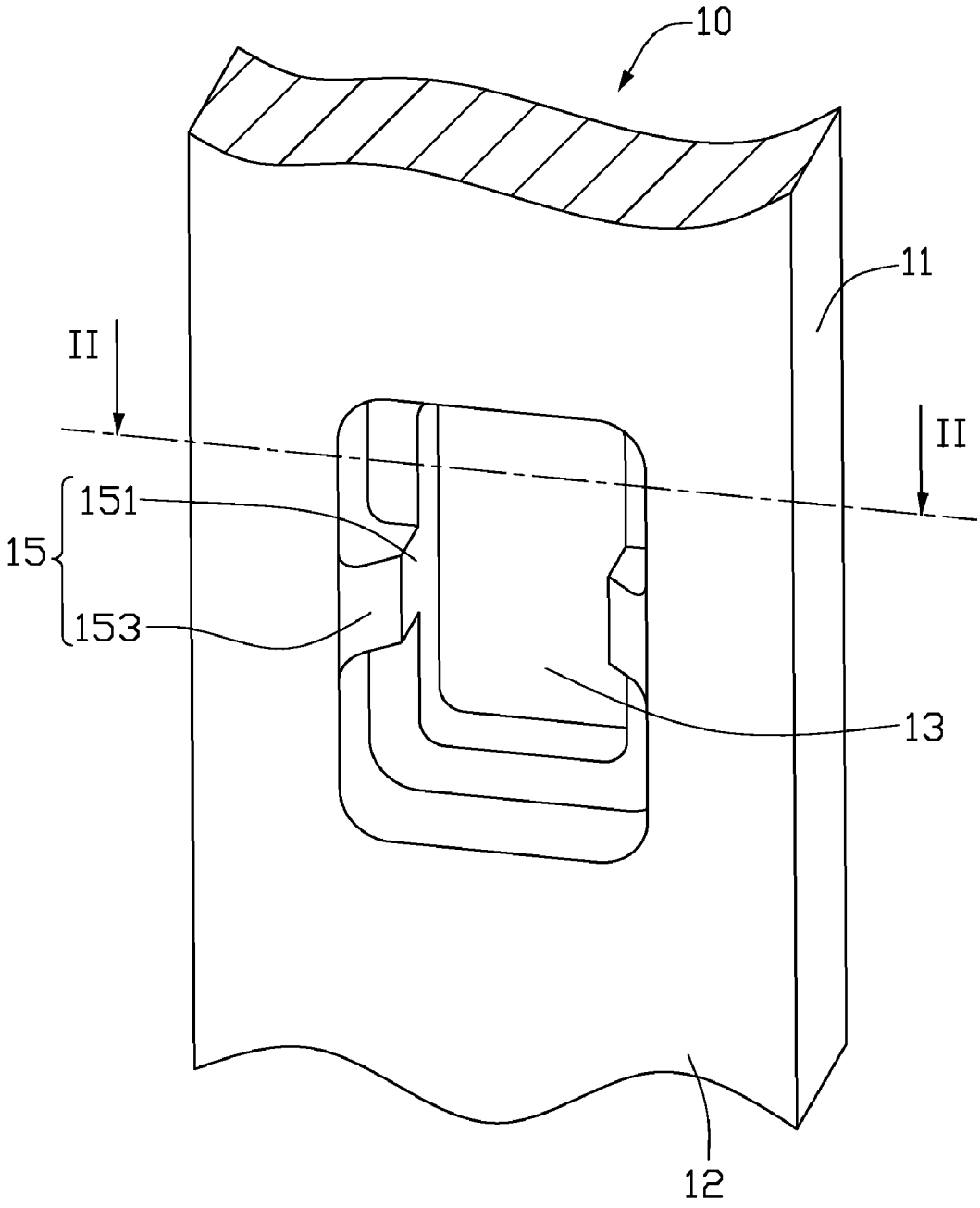
FIG. 1 is an isometric view of a positioning structure for a USB connector in accordance with a first exemplary embodiment of the present invention.
Figure 2:
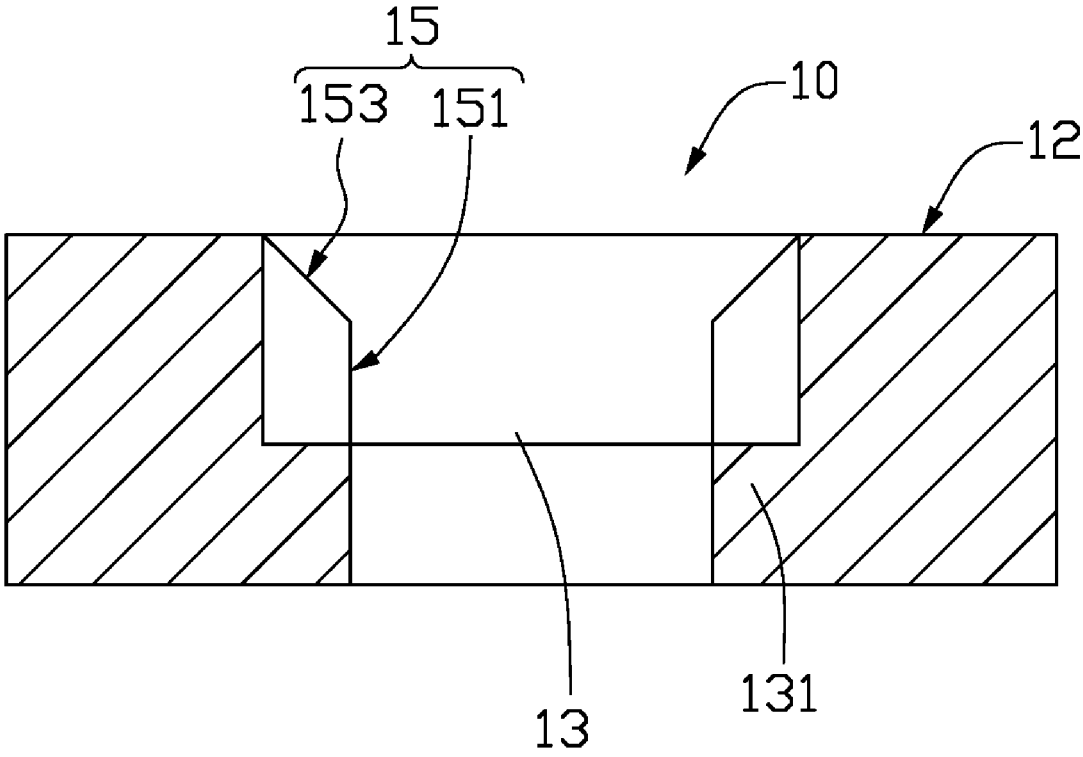
FIG. 2 is side, cross-sectional view of the positioning structure for assembling the USB connector of FIG. 1, taken along line II-II thereof.

Referring to FIGS. 1 and 2, a positioning structure 10 for a USB connector (not shown) assembled with an electronic device (not labeled) according to a first exemplary embodiment is shown. The positioning structure 10 includes a main body 11 of the electronic device. The main body 11 has an inner surface 12, a through hole 13 defined in the main body 11, and a guiding portion 15 configured on an inner sidewall of the through hole 13. A socket/female portion of the USB connector may be assembled from a side of the inner surface 12.

In this embodiment, a ledge 131 is formed on the inner sidewall of the through hole 13. The guiding portion 15 is positioned on a part of the ledge 131 adjacent to the inner surface 12. The guiding portion 15 consists of two blocks facing each other. Each block includes a restricting surface 151, and a guiding surface 153. The restricting surface 151 is coplanar with the inner sidewall of the first hole 13. The guiding surface 153 is a slanted surface that interconnects the restricting surface 151 and the inner surface 12. A distance between the guiding surfaces 153 of the blocks increases along a direction from the ledge 131 to the inner surface 12. In another words, the distance between the guiding surfaces 153 of the blocks decreases along a direction towards which the socket/female portion of the USB connector is inserted.

In assembling, the socket/female portion of the USB connector is assembled to the through hole 13 from the side of the inner surface 12 guided by the positioning structure 10. Therefore, the socket/female portion of the USB connector may be easily engaged in the through hole 13. In addition, the restricting surface 151 and the ledge 131 may restrict positioning of the socket/female portion of the USB connector and enable a space between the socket/female portion of the USB connector and the sidewall of the through hole 13 uniform, thereby preserving the desired appearance of the computer.

In addition, to improve a performance of connection between the socket/female portion of the USB connector and the sidewall of the through hole 13, edges of the sidewall of the through hole 13 and the guiding portion 15 are rounded. The guiding portion 15 may be made of rubber.

Figure 3:
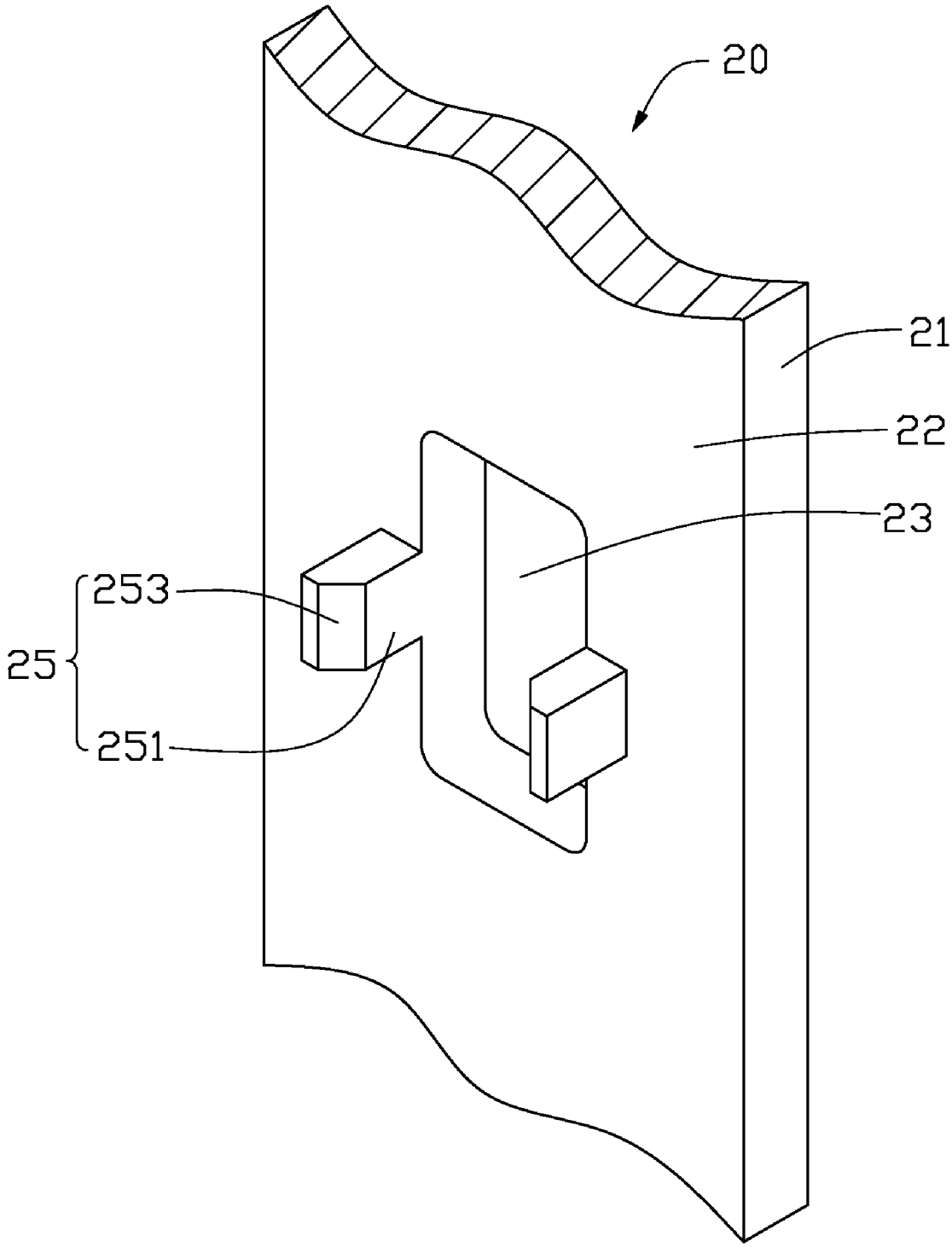
FIG. 3 is an isometric view of a positioning structure for a USB connector in accordance with a second exemplary embodiment of the present invention.

Referring to FIG. 3, a positioning structure 20 for a USB connector according to a second exemplary embodiment is shown. The positioning structure 20 is similar in principle to the positioning structure 10 of the first embodiment. The positioning structure 20 includes a main body 21 of an electronic device. The main body 21 has an inner surface 22, a through hole 23 defined in the main body 21, and a guiding portion 25. However the guiding portion 25 consists of two protrusions extending from an inner surface 22 at a periphery of the through hole 23. Each bottom surface of the guiding portion 25 is coplanar with the inner surface 22. Each guiding surface 253 connects to the restricting surface 251. A distance between the guiding surfaces 253 decreases along a direction from the guiding portions 25 to the through hole 23.

Figure 4:
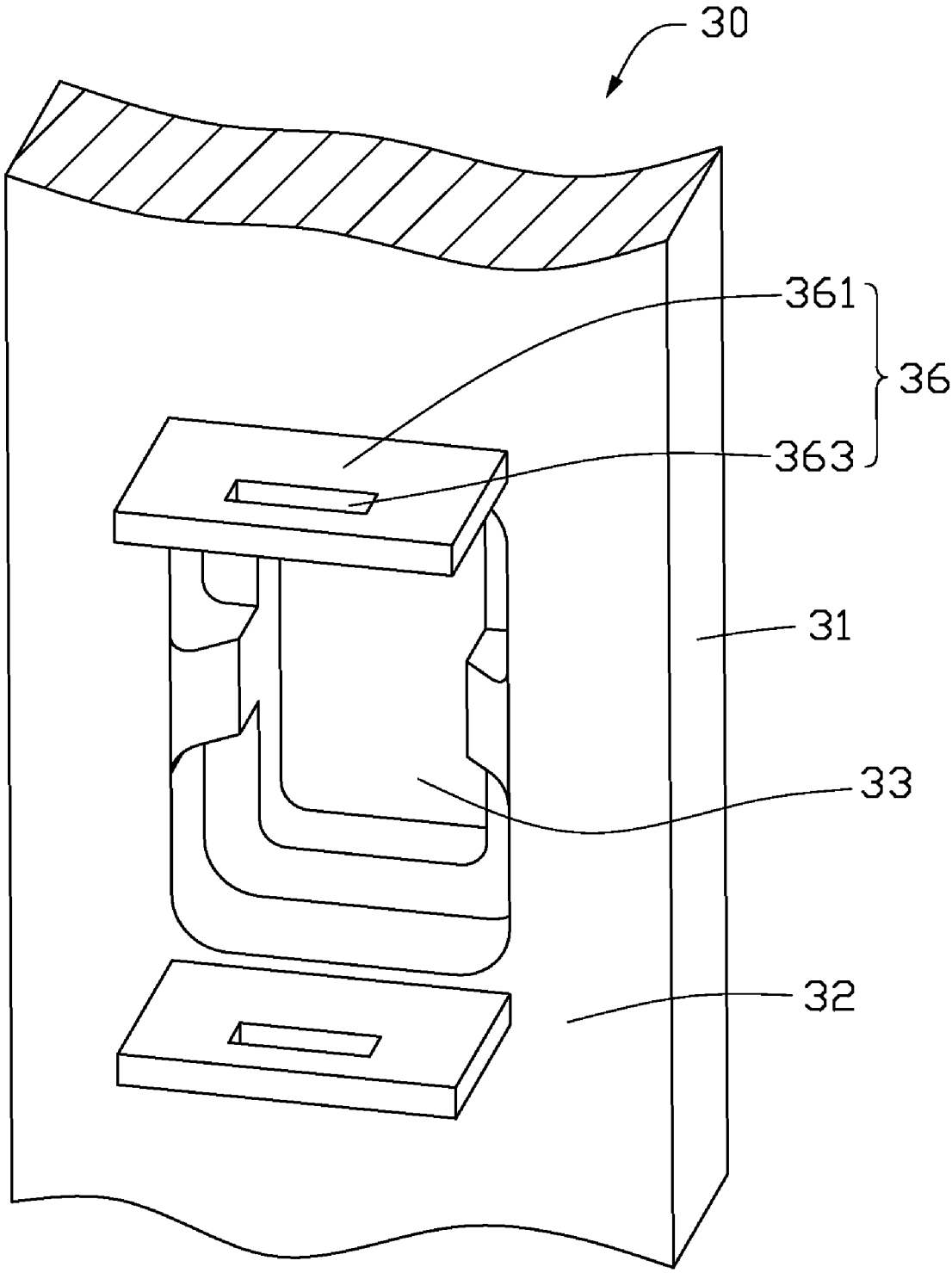
FIG. 4 is an isometric view of a positioning structure for a USB connector in accordance with a third exemplary embodiment of the present invention.

Referring to FIG. 4, a positioning structure 30 for a USB connector according to a third exemplary embodiment is shown. The positioning structure 30 is similar in principle to the positioning structure 10 of the first embodiment. The positioning structure 30 includes a main body 31 of an electronic device. The main body 31 has an inner surface 32, a through hole 33 defined in the inner surface 32. However, the positioning structure 30 further includes two fixing elements 36 on the inner surface 32 adjacent to the through hole 33. Each fixing element 36 includes a fixing board 361, and a fixing hole 363 defined on the fixing board 361. The fixing holes 363 are used for engaging with protrusions on the USB connector, thereby preventing the USB connector from breaking off from the main body 31.

Figure 5:
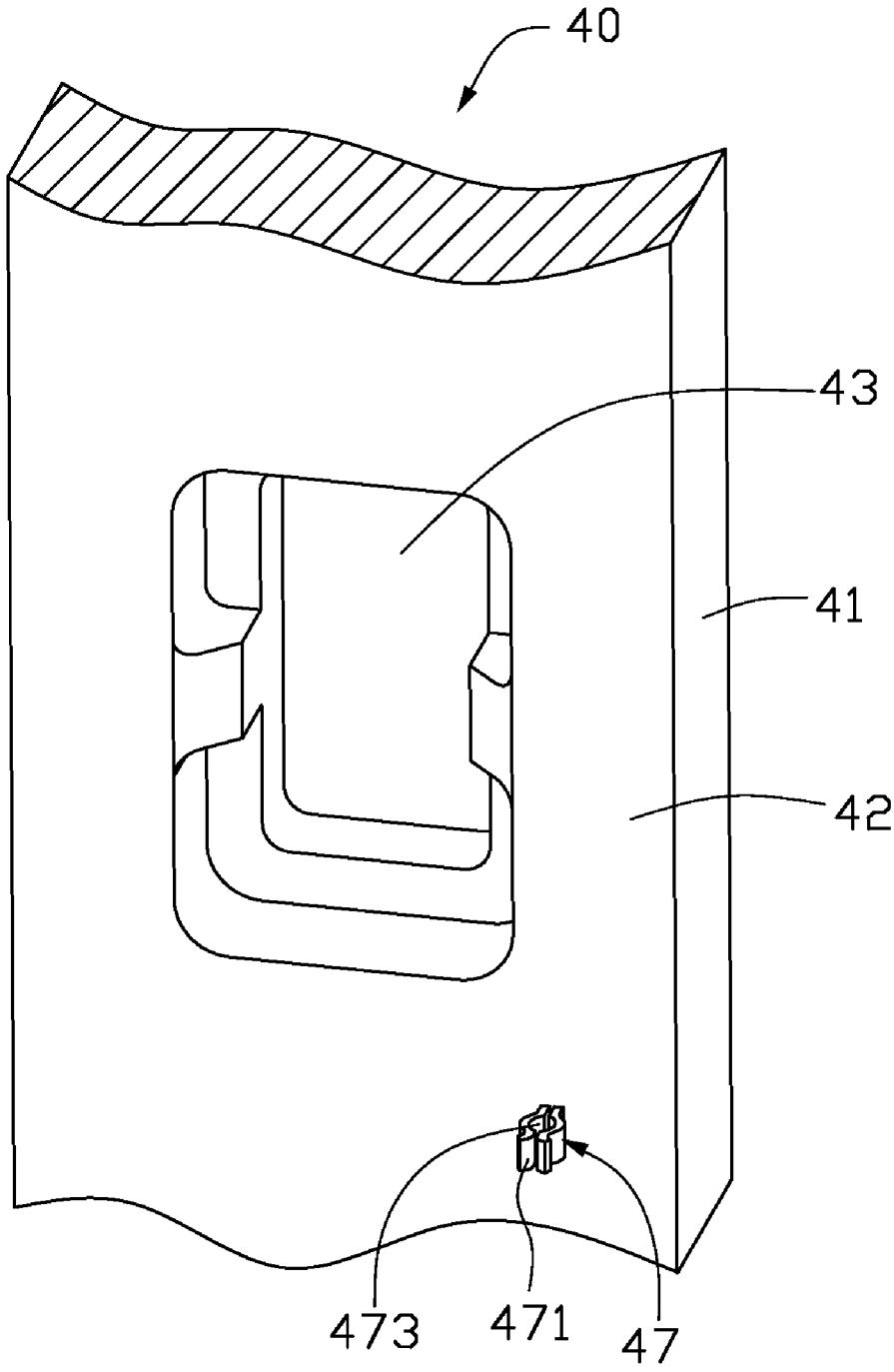
FIG. 5 is an isometric view of a positioning structure for a USB connector in accordance with a fourth exemplary embodiment of the present invention.

Referring to FIG. 5, a positioning structure 40 for a USB connector according to a fourth exemplary embodiment is shown. The positioning structure 40 is similar in principle to the positioning structure 10 of the first embodiment. The positioning structure 40 includes a main body 41 of an electronic device. The main body 41 has an inner surface 42, a through hole 43 defined in the inner surface 42. However, the positioning structure 40 includes a clamp 47 located on the inner surface 42 beside the through hole 43. The clamp 47 includes two elastic curved boards 471. The elastic curved boards 471 cooperatively define a receiving hole 473 for receiving an electrical wire of the USB connector. In use, the electrical wire of the USB connector may be fixed by the clamp 47, thereby preventing the electrical wire from breaking away from a weld.

It is noted that the scope of the present positioning structure is not limited to the embodiments described above. For example, in the positioning structure 10, a number of the guiding portion 15 may be two, or more. The USB connector may be fixed on the main body 11 by an adhesive. In addition, the socket/female portion of the USB connector may be configured on the outer side of the main body 11, and a plug/male portion of the USB connector may be configured to inserting and pass through the through hole 13 to engage with the socket/female portion from the side of the inner surface 12.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A positioning structure for a USB connector assembled with an electronic device including a main body, the positioning structure comprising: a through hole defined in the main body, and a guiding portion configured on a periphery of an inner sidewall of the through hole, wherein a ledge form is formed on an inner sidewall of the through hole to receive the USB connector; the guiding portion consists of at least two blocks located on a part of the ledge; each block comprises a guiding surface, the guiding surface being a slanted surface with one side extending to a surface of the ledge.

2. The positioning structure for a USB connector as claimed in claim 1, wherein the guiding portion is made of rubber.

* * * * *